US005575399A

United States Patent [19]

Intini

[11] Patent Number: 5,575,399

[45] Date of Patent: Nov. 19, 1996

[54] CONTAINER

[76] Inventor: Thomas D. Intini, 9270 Recollet Street, Ville Brossard, Quebec, Canada

[21] Appl. No.: 294,912

[22] Filed: Aug. 24, 1994

Related U.S. Application Data

[60] Division of Ser. No. 31,724, Mar. 15, 1993, Pat. No. 5,346,069, which is a continuation-in-part of Ser. No. 949, 984, Sep. 24, 1992, abandoned.

[51] Int. Cl.[6] ..... B65D 43/22

[52] U.S. Cl. ..... 220/326; 220/339

[58] Field of Search ..... 220/324, 326, 220/339

[56] References Cited

U.S. PATENT DOCUMENTS

| | | | |
|---|---|---|---|
| 3,524,564 | 8/1970 | Schurman | 220/324 X |
| 4,293,266 | 10/1981 | St. Lawrence et al. | 414/411 |
| 4,344,646 | 8/1982 | Michel | 292/87 |
| 4,365,711 | 12/1982 | Long et al. | 206/387 |
| 4,733,794 | 3/1988 | Kent | 220/306 |
| 4,767,008 | 8/1988 | Warnecke et al. | 206/570 |
| 5,267,668 | 12/1993 | Jones | 220/326 |
| 5,272,832 | 12/1993 | Marshall et al. | 43/131 |
| 5,285,918 | 2/1994 | Weisburn et al. | 220/265 |
| 5,295,602 | 3/1994 | Swanson | 220/306 |
| 5,346,069 | 9/1994 | Intini | 206/531 |
| 5,394,902 | 3/1995 | Shibao | 137/565 |

*Primary Examiner*—Stephen P. Garbe
*Attorney, Agent, or Firm*—Eric Fincham

[57] ABSTRACT

The present invention provides a child resistant container suitable for packaging of medicines and the like wherein a bottom portion designed to hold the product and a cover member have first and second cooperative locking devices with the first locking device permitting a certain limited movement while maintaining a locked position such that when the second locking device is moved to an unlocked position, the first locking device remains locked until a second step or operation is performed thereon. Operation of the second locking device to unlock it tends to reinforce the locking action to the first locking device to prevent simultaneous unlocking of both locking devices.

8 Claims, 5 Drawing Sheets

68
38
30
70
16
10

14
56
26
30
38
52'
52
16
6
6

32
20
26
14
16
30
12
10
3
3

CONTAINER

This is a Divisonal of application Ser. No. 08/031,724 filed Mar. 15, 1993, now U.S. Pat. No. 5,346,069 which in turn was a Continuation-in-part of application Ser. No. 07/949,984 filed Sep. 24, 1992, now abandoned.

The present invention relates to containers and more particularly, it relates to child resistant container packaging.

The use of child resistant packaging is well known in the art and is utilized for many different types of goods. Primarily, this packaging is used for those products which represent a potential hazard in the hands of children—i.e. medicaments and the like. The approach adapted for the child proofing of the packaging primarily depends upon the product per se—i.e. its size, format, etc. Thus, for example, in the field of medicines many different types of pill containers which have locking tops are well known and are widely used commercially. Similarly, individually packaged medicaments are often sealed in different types of blister packages which are designed to prevent easy access by children.

In designing child resistant packages, it is also important that the package can be opened without undue difficulty by the average consumer for whom the product is intended. This is frequently a problem in that one of the primary groups of medicament users are the elderly, and packaging which relies on a certain amount of strength to open is often self defeating in that the end users find it difficult or impossible to open such packaging.

Many pharmaceutical products are packaged in the form of pills or tablets and, as above mentioned, are sealed in blister packages. Frequently these packages are difficult for the elderly to open.

It is an object of the present invention to provide child resistant packaging suitable for a number of different items wherein a substantial amount of strength is not required and yet incorporates child resistant features.

It is a further object of the present invention to provide a self dispensing package for a pharmaceutical product wherein the product is packaged in blister packs.

According to one aspect of the present invention, there is provided child resistant packaging comprising a bottom member adapted to receive and contain at least one item to be packaged, said bottom member having a base and at least one wall extending upwardly therefrom, a cover member, first and second cooperative locking means on both said cover member and said bottom member, both of said first and second locking means being operative such that when said cover member is in a closed position with respect to the container member said locking means function to maintain the cover member and bottom member in a locked relationship, said second locking means permitting limited movement between the cover member and bottom member while maintaining a locking relationship such that said first locking means may be moved from a locked to an unlocked position while said second locking means are locked.

Also, according to the present invention, there is provided a child resistant container which comprises a bottom member adapted to receive and contain at least one item to be packaged, the bottom member having a base and at least one wall extending upwardly therefrom. A cover member is provided to cover the open mouth of the container. At least first and second cooperative locking means are provided on both the cover member and the bottom member. The first locking means has tab means associated with one of the members, the tab means being engagable with recess means provided on the other of said members. Similarly, the second locking means also includes tab means formed on one of the said members, the tab means being engagable with recess means on the other of the members. The arrangement is such that when the first locking means are unlocked by disengagement of the tab means with the recess means, this disengagement action causes a more secure engagement of the second locking means to thereby render more difficult operation of the first and second locking means simultaneously.

There is also provided a child-resistant package which comprises a bottom member and a cover member, the package being of a substantially rectangular configuration, the bottom and cover members being formed integrally with a hinge member extending a substantial length along one side of the cover and bottom members, first and second cooperative locking means located on opposed sides of the cover and bottom members, each of the locking means comprising a tab formed integrally with one of said members, a recess formed in the other of said member to receive the tab and engage the tab in a locking relationship, the locking means being spaced apart a sufficient distance to prevent operation of both locking members simultaneously by a child.

There is also provided a self-dispensing package for a pharmaceutical product which is contained in a cavity formed in a blister layer of a blister pack and which has a rupturable film enclosing the product in the cavity. The package comprises a bottom member and a cover member, the bottom and cover members being connected by a hinge portion which may conveniently be formed integrally with the package. A track is located on an inner surface of the cover member and at least one plunger is slidably mounted on the track and moveable therealong. The interior of the package has means for receiving a blister pack such that when the cover member is closed, the plunger contacts a blister layer and forces the product package therein through the rupturable film to thereby dispense the product.

In greater detail, the present invention provides packaging which may be utilized for a number of different products although a primary use is the medical field where child resistant features are important. Since it is a container suitable for any number of products including bulk goods, a wide variety of products can be packaged therein. For reasons which will become apparent hereinafter, the container is preferably formed as a one piece unit and is of a suitable plastic material such as polyethylene or polypropylene for reasons of functionality and ease of manufacture.

In general, the packaging includes a bottom container member which is adapted to receive and contain the articles to be packaged. This container member portion may assume many different configurations such as circular, oval, rectangular, etc. Generally, however, it can be characterized as having a base portion with at least one wall extending upwardly therefrom to thereby form a container adapted to receive and retain the commodity therein. At the upper end of the walls is a mouth portion through which the contents of the container portion may be accessed.

A cover member is provided to cover the mouth of the container and which cover member can be of any conventional configuration. Although the cover can be a separate member, in a preferred embodiment it is formed with the container bottom and is hingedly connected thereto. In this embodiment the hinge connection is known as a "living hinge".

The cooperative locking means associated with the cover and the container bottom preferably comprise separate first and second locking means. Although both locking means function to retain the cover in the closed position, one of the first locking means allows limited movement between the cover member and the bottom member such that the other locking means may be unlocked while the first locking means maintains a locked position or relationship. By so doing, one can move the first locking means from a locked to an unlocked position while the second locking means is still in its locked position. One must then perform a second sequential operation to unlock the second locking means to permit removal of the cover from the mouth of the container and permit access to the contents thereof. This two part sequential operation provides effective child resistant features for this embodiment.

Preferably, the cooperative locking means comprise a tab formed on one of the cover or bottom members and a recess formed on the other of the members. For purposes of discussion herein, the tab member will be referred to as being on the bottom container member while the recess will be described as being formed in the cover member. It will be understood that the reverse situation may also apply and indeed, combinations of the same may be utilized as will become apparent from the detailed description. Similarly, description of the locking means will be with respect to a somewhat rectangularly configured container although, as previously pointed out, many different shapes may be utilized.

In the preferred embodiment, the second locking means comprises at least one tab member and one recess formed on a side of the container. More preferred is the arrangement wherein the second locking means comprises a pair of locking devices on opposed sides of the container with the first locking means being located on the front of the container.

In the preferred arrangement, the first locking means comprises a tab member extending upwardly from the front wall of the bottom member with the tab being formed integrally as a portion of the package. The tab preferably has an outwardly extending flange at an upper portion thereof which will fit with within a recess formed within the front wall of the cover member. The formation of the tab per se and the operation thereof is conventional as with known tab locking devices. Operation of the first locking means to unlock the container consists of an inward pressure applied on the front wall of the bottom portion proximate the tab member to thereby urge the tab member from its engagement with the recess and thereby permit movement of the cover.

To provide the sequential steps for the child resistant features for the above embodiment, the second locking means are located on the side of the container. Preferably, identical locking devices on opposed sides are provided. The preferred embodiment again utilizes a tab extending upwardly from the marginal edge of the side walls of the bottom member and recesses located in the side walls of the cover member. The recesses may be formed in the side walls or in one embodiment, may merely consist of apertures with which the tab member engages and enters into a locking relationship.

The locking devices of the second locking means provide for a limited movement of the cover member visa vis the bottom member when in a locked position. In other words, the engagement of the tab member with the recess still permits a limited upward movement of the cover member. With this arrangement, the first locking means may be unlocked and the cover member moved upwardly to prevent relocking thereof while the second locking means remain in a locked position.

Furthermore, the arrangement is such that when pressure is exerted on the front wall of the bottom member proximate the tab member to move it out of locking relationship with the corresponding recess, this pressure transmits a force to the side walls of the bottom member which in turn tends to force the tab member(s) of the second locking means into tighter engagement with their corresponding recesses. Thus, barring the use of unusual force, all the locking devices cannot be opened simultaneously.

In a further embodiment of the invention, a somewhat smaller version of the package may be employed. In this version, there is only provided locking means on opposed sides of the container. However, the container is dimensioned so as to make it difficult for a child to open the same—i.e. the distance between the locking means is such that a single hand cannot be used to operate the opposed locking devices.

In a variation of the packaging, the package may be changed into a self-dispensing package for products which are packed in blister packs. To this end, the interior of the package will include means for receiving the blister pack and holding it in a fixed position. On the interior surface of the cover member there is provided means for contacting the blister layer and forcing the product contained in the blister cavity through the rupturable film. These means comprise a plunger which preferably is moveable to different positions, including a position where it does not contact any of the blister cavities. Conveniently, this may be arranged by a plunger member which is slidable along a track formed on the interior surface of the cover member. In the preferred embodiment, the bottom of the package will have a plurality of apertures formed therein and which apertures are in registry with the cavity formed in the blister package. Thus, once the product is forced through the rupturable film, it will exit the package through the aperture. For greater convenience, the bottom member may also include pads or feet such that when it is placed on a surface and operated to force a product through the aperture, there is enough space left for the product between the surface and the bottom member.

Naturally, one could vary the arrangement of the bottom to a certain extent. Thus, it could be a false bottom embodying the apertures mentioned above with the tab then falling onto the true bottom from where it may be dispensed. Other similar arrangements could also be used.

Having thus generally described the invention, reference will be made to the accompanying drawings illustrating embodiments thereof, in which:

FIG. 1 is a perspective view of a container according to the present invention;

FIG. 1*a* is a detailed view of a variation of the locking means according to the invention;

FIG. 2 is a front view illustrating opening of the container;

FIG. 2*a* is a front view illustrating a second step in the opening of the container;

Figures 1, 1A, 2, 2A:
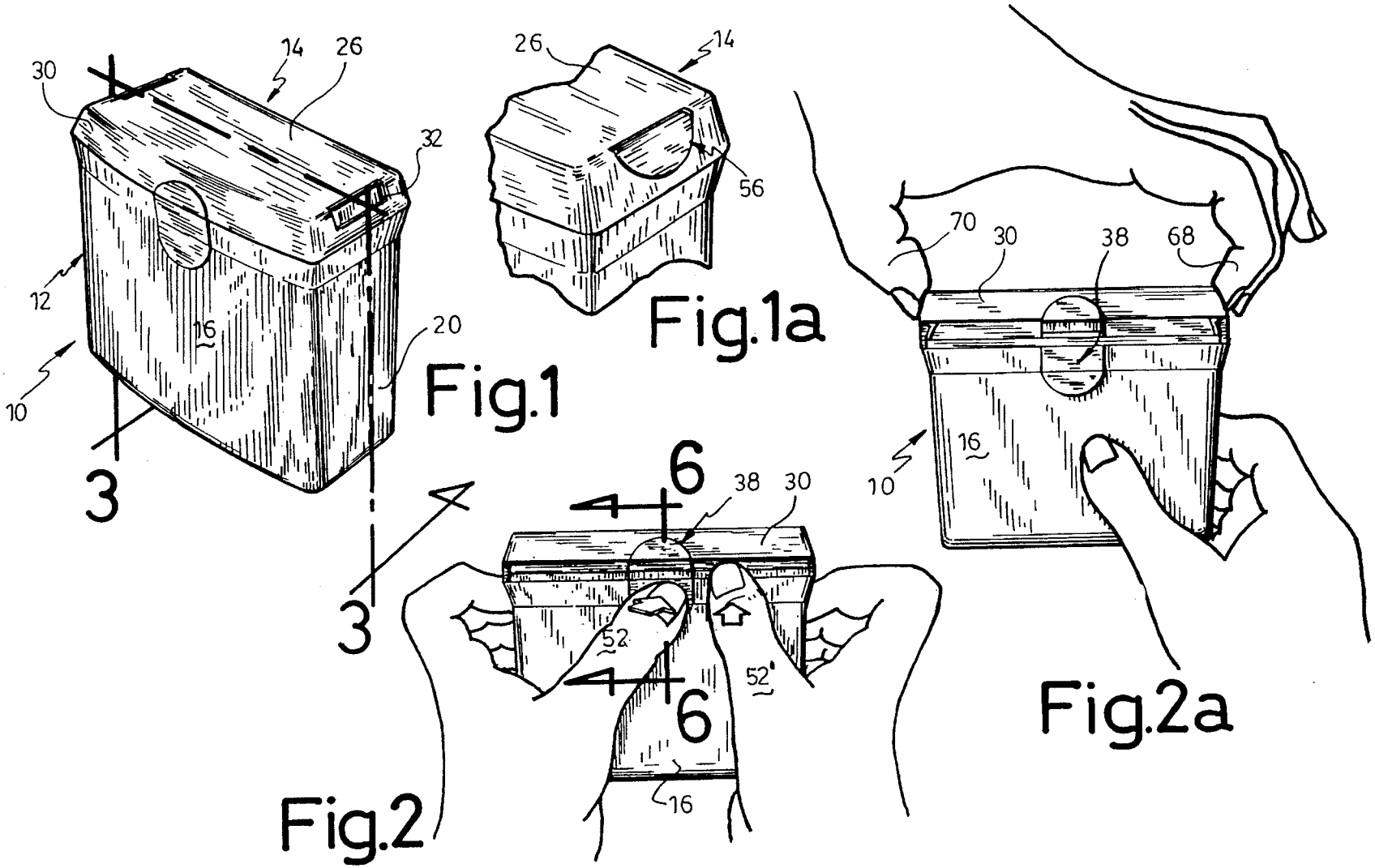
Figure 5:
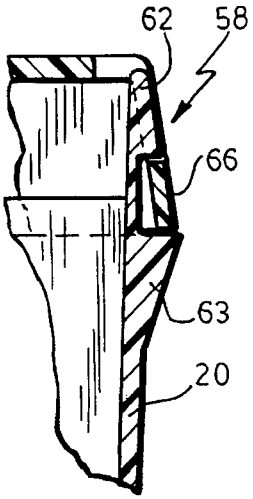
FIG. 5 is an expanded sectional view of the area indicated by arrow 5 of FIG. 3.
Figure 5A:
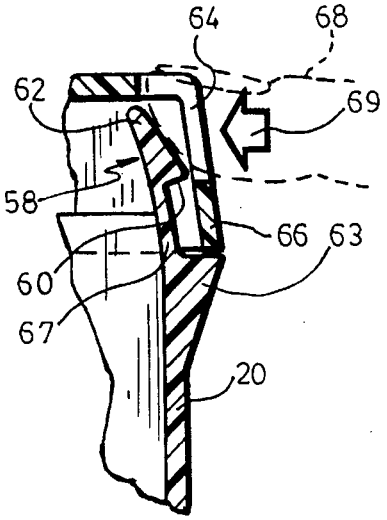
Figure 6:
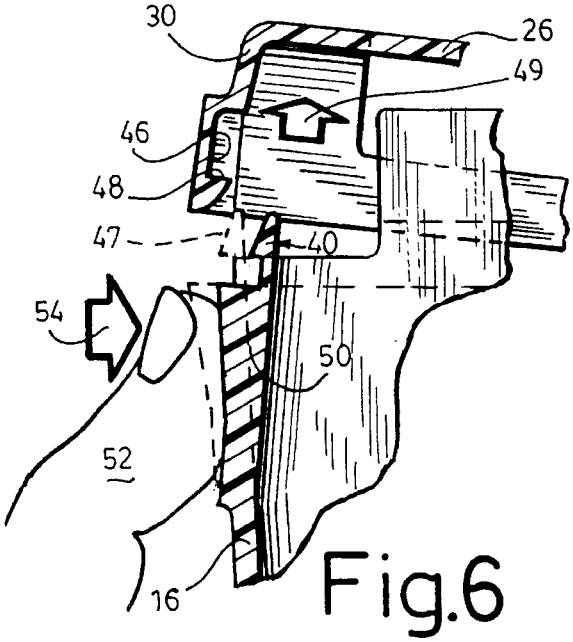
Figure 6A:
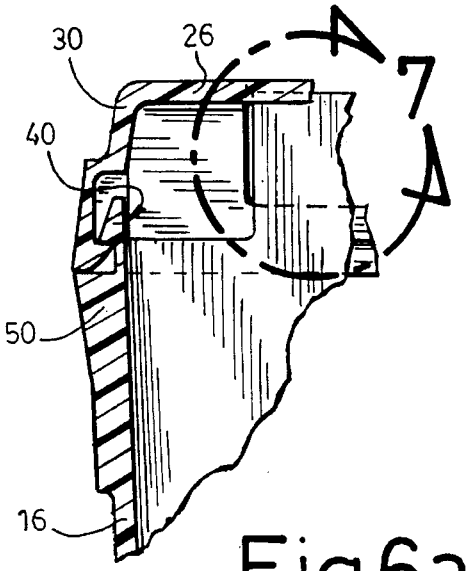
Figure 7:
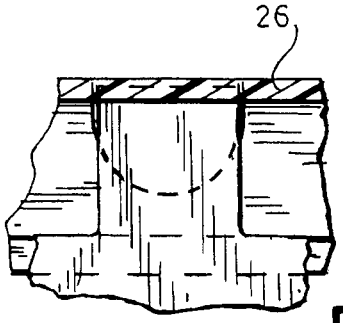

FIG. 5*a* is a view similar to FIG. 5 showing operation of the locking means;

FIG. 6 is a sectional view taken along the lines 6—6 of FIG. 2;

FIG. 6*a* is a view similar to FIG. 6 showing the locking means in a closed locked position;

FIG. 7 is a detailed view of the area indicated by arrow 7 in FIG. 6*a;*

Figure 8A:
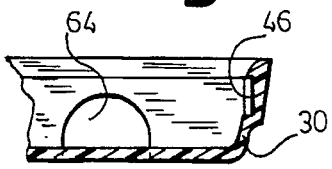
Figure 8:
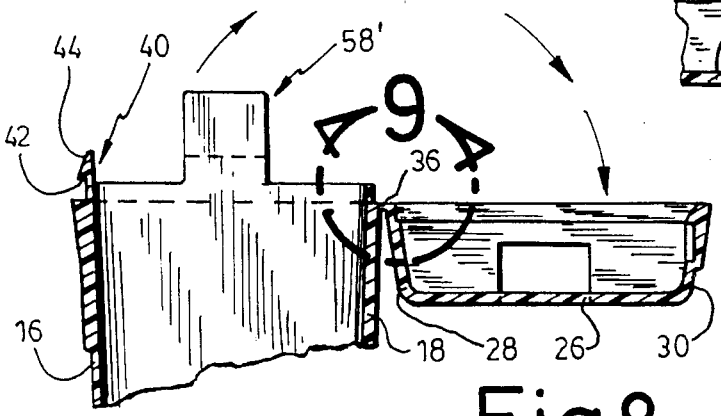
Figure 9:
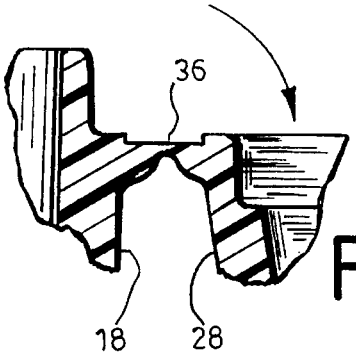

FIG. 8 is a partial sectional view showing the opening of the cover;

FIG. 8A is an enlarged sectional view showing the aperture in the cover;

FIG. 9 is a detailed view of the area indicated by arrow 9 in FIG. 8.

Figure 10:
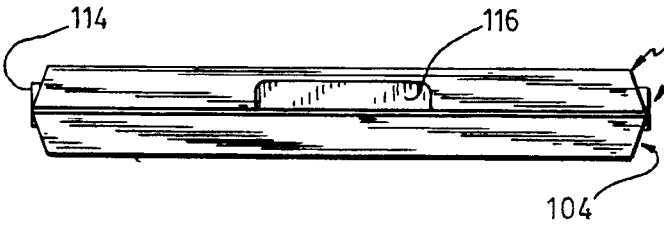
Figure 11:
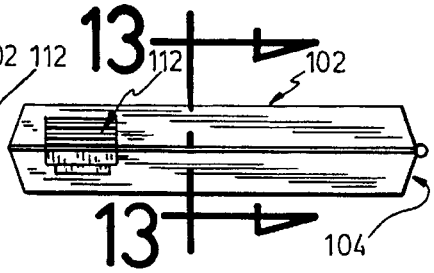
Figure 12:
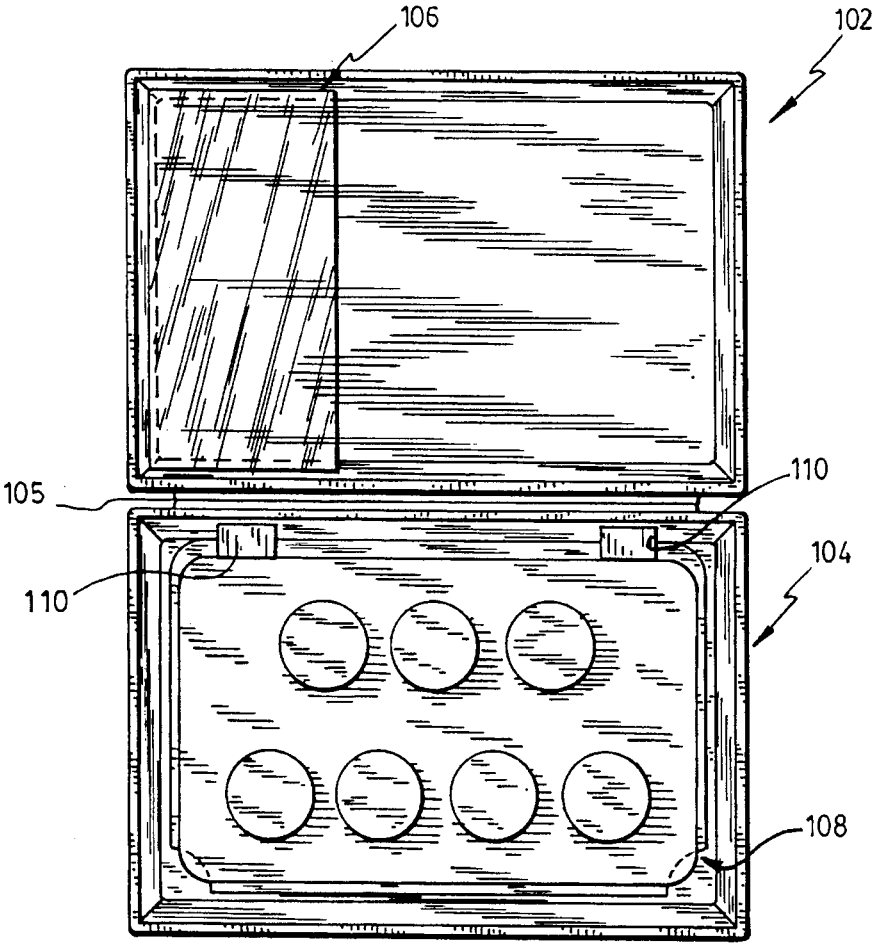
Figure 13:
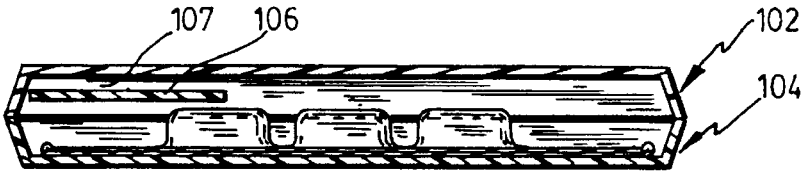

FIG. 10 is a front elevational view of a further embodiment;

FIG. 11 is an end elevational view thereof;

FIG. 12 is a top plan view of the opened package of the embodiment of FIG. 10;

FIG. 13 is a cross sectional view of the embodiment of FIG. 10.

Figure 14:
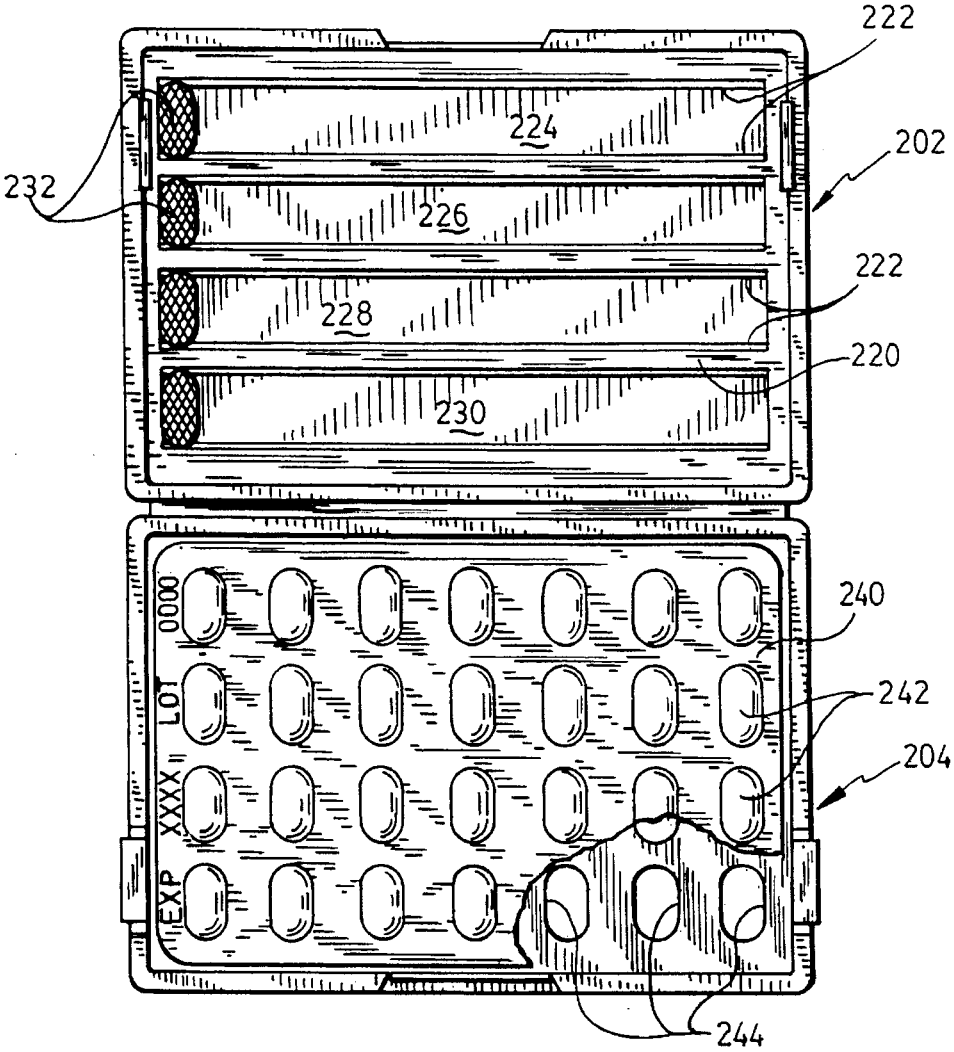

FIG. 14 is a top plan view of a further embodiment of a package; and

Figure 15:
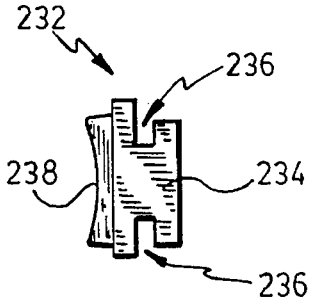

FIG. 15 is an end view of the plunger.

Referring to the drawings in greater detail and by reference characters thereto, FIG. 1 illustrates one embodiment of a container package according to the present invention. The container is generally designated by reference numeral 10 and has a bottom member 12 and a cover member 14. Bottom member 12, is of a substantially rectangular cross sectional configuration having a front wall 16, a back wall 18 and a pair of side walls 20 and 22. A base 24 forms the bottom of the container from which the side walls extend upwardly. Cover member 14 includes a top wall 26, a cover back wall 28, a cover front wall 30, and a pair of cover side walls 32 and 34.

Cover member 14 and bottom member 12 are preferably formed as a single unit and thus, there is provided a hinge 36 which extends along substantially the whole length of back walls 18 and 28. As previously mentioned, the container is preferably molded of a suitable plastic material and the hinge arrangement shown is referred to as a "living hinge".

A first locking means is generally designated by reference numeral 38 and is located on the front walls 16 and 30 of the container. As may be best seen in FIGS. 6, 6*a* and 8, the first locking means includes a tab member 40 extending upwardly from front wall 16 of bottom member 12. Tab member 40 is formed to have an outwardly extending flange area 42 and a tapered portion 44. A reinforced area 50 is provided in wall 16 proximate the area of tab 40.

Formed in front wall 30 of cover member 14 is a recess generally designated by reference numeral 46 and which includes an inwardly extending shoulder 48. As may be seen from FIG. 6*a*, the tapered portion 44 is adapted to seat within recess 46 with flange 42 of tab 40 mating or engaging with shoulder 48 as may be seen in FIG. 6*a*. The resulting locking action is secure.

To open the container, inward pressure is applied to reinforced area 50 by finger 52 in the direction indicated by arrow 54. The tab member moves from its original position indicated by dotted lines 47 inwardly through the position indicated in FIG. 6 to thereby release the tab from recess 46 and permit upward movement of the cover as indicated by arrow 49.

Second locking means are provided and consist of a pair of locking devices 56 and 56'. Devices 56 and 56' are identical and only one will be described herein.

Figure 3:
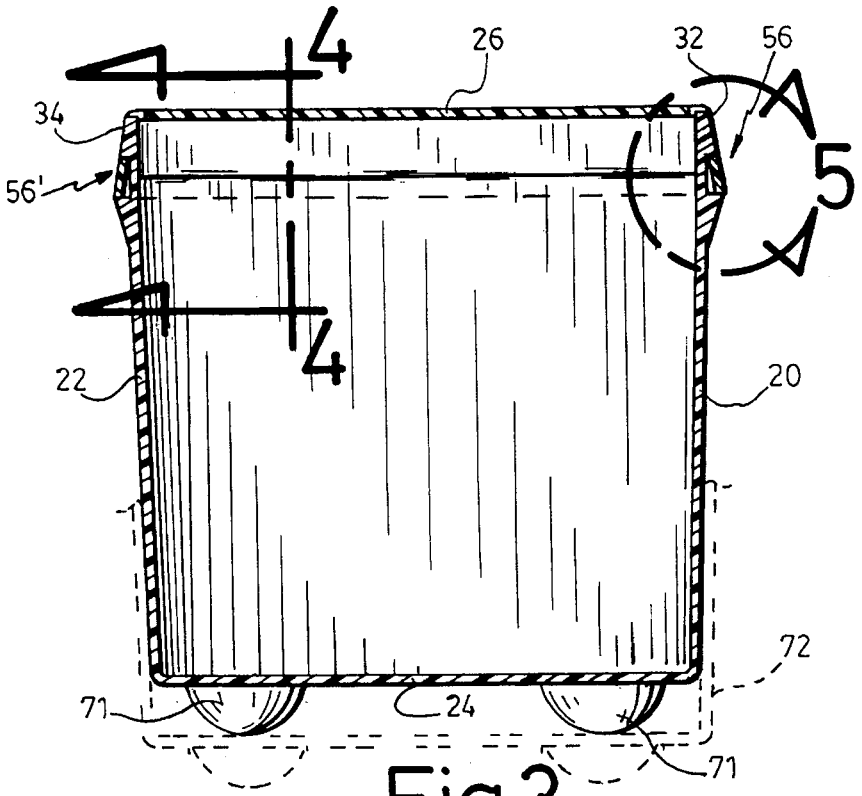
FIG. 3 is a sectional view taken along the lines 3—3 of FIG. 1.
Figure 4:
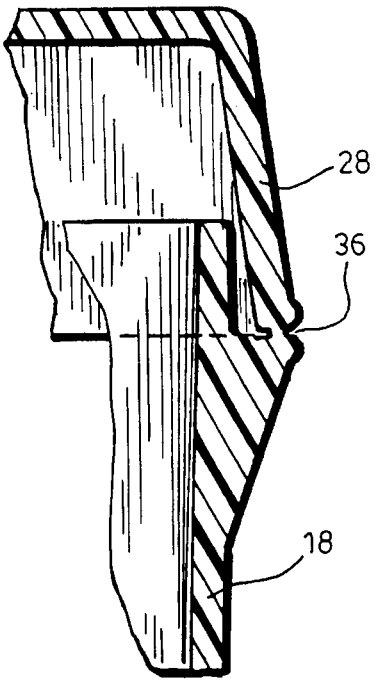
FIG. 4 is a sectional view showing the hinge portion of the container taken along the lines 4—4 of FIG. 3.

Referring to FIGS. 3, 5 and 5*a* which best illustrate the second locking means, it will be seen that locking device 56 is similar to the first locking means. Thus, there is provided an upwardly extending tab 58 from side wall 20 with a reinforced area 63 proximate thereto. Tab 58 includes an outwardly extending flange portion 60 and a tapered portion generally designated by reference numeral 62. Formed in side wall 32 of cover member 14 is a recess or aperture 64 into which tapered portion 62 of tab 58 sits to provide a locking relationship between the cover member 14 and bottom member 12. It is important to note that portion 66 of side wall 32 is sized to be somewhat smaller than portion 67 of tab 58 to thereby allow a limited upward movement of cover member 14 while still maintaining the locking relationship. To open the locking device 56, inward pressure is exerted by digit 68 in the direction indicated by arrow 69.

In operation, and as indicated in FIGS. 2 and 2*a*, the container is opened by firstly applying an inward pressure by means of digit 52 to reinforced area 50 on front wall 16. This disengages tab 40 from engagement with recess 46 and permits upward movement of the cover member 14. This upward movement may be assisted by using digit 52' as shown in FIG. 2. Meanwhile, complete release of the cover is prevented due to locking devices 56 and 56'. They allow a sufficient upward movement to prevent re-engagement of the first locking means but prevent complete removal of the cover. Subsequent to the first operation, digit 68 and 70, as shown in FIG. 2*a*, apply pressure to tabs 58 and 58' to fully release the cover member.

It will be noted that attempts to operate all three of the locking devices at one time are counter productive since the force exerted by digit 52 as indicated in FIG. 6 on front wall 16 will cause pressure to be transmitted to side walls 20 and 22 and thereby to the respective tab members thereon. This forces the tab members to more tightly engage the appropriate recesses.

For purposes of manufacture, as shown in FIG. 3, a plurality of legs 71 may be provided during the manufacturing process to provide for ease of nesting of the containers within one another as indicated by dotted lines 72.

In a further embodiment of the invention shown in FIGS. 10 to 13, a somewhat more compact version of the container is illustrated and which version is suitable for medicaments such as some pills and the like. In this embodiment, there is provided a cover member 102 and a bottom member 104 which are secured together by an integral living hinge member 105.

Formed in top member 102 is a pocket 107 by means of a dividing plate member 106. Pocket 107 can be utilized for placing pamphlets and literature concerning the product dispensed in the container.

The package includes a pair of hinge members 110 onto which a divider 108 is mounted. Divider 108 can be utilized to retain pills in a blister package in the desired position.

Provided on either side of the package are a pair of locking means 112 and 114, which are substantially identical. The locking means comprises a tab member as in the previously described embodiment extending downwardly from cover member 102 to engage in a recess formed in bottom member 104. A ribbed portion is formed on the exterior surface of the upper portion of the tab member. The space between locking means 112 and 114 is sufficient that a typical childs hand cannot grasp the tab means between a thumb and finger to open the top as an adult would be capable of. As shown in FIG. 10, a reinforced area 116 may be provided on the front surface of cover member 102 to assist in opening the package although this does not include a locking means as in the previous embodiments.

Referring to FIG. 14, there is illustrated a container similar to that of the one described above with respect to FIG. 10 to 13. In this particular embodiment, cover member 202 has, on interior surface 220 a plurality of rails 222 which extend substantially parallel to each other. Two of such rails 222 will form a track and thus, there are illustrated four separate tracks, 224, 226, 228 and 230. Mounted in each track is a plunger 232 (FIG. 15) and which plunger 232 has a body portion 234 with a recess 236 formed in each side thereof. Recesses 236 are adapted to receive a projection (not shown) formed on rails 222 such that the plunger 232 is slidable there along. A blister engaging surface 238 of plunger 232 is adapted to contact the blister pack and when the cover is closed, it exerts sufficient pressure on the blister to force the product through the rupturable layer.

As shown in FIG. 14, blister pack 240 is adapted to fit within bottom member 204 and includes a plurality of blisters 242 which are aligned in four separate rows to correspond with the tracks and associated plungers. It is evident that one may utilize various stop means to align the plungers in the desired positions as well as having a non-operative position as shown in FIG. 14. Desirably, bottom member 204 will include a plurality of apertures 244 in registry with each of the blisters 242 such that the product is dispensed to the exterior of the package. Also, as mentioned with respect to the other embodiments of this invention, the package may include integrally formed legs or pads to space the bottom of the package from a surface upon which it is placed and to allow the easy dispensing of this product through the aperture in the bottom member.

It will be understood that changes and modifications may be made to the above described embodiments without departing from the spirit and scope of the invention.

I claim:

1. A child resistant package comprising a bottom member adapted to receive and contain at least one item to be packaged, said bottom member having a base and at least one wall extending upwardly therefrom, a cover member, first and second cooperative locking means on both said cover member and said bottom member, both of said first and second locking means being operative such that when said cover member is in a closed position with respect to the bottom member said locking means function to maintain the cover member and bottom member in a locked relationship, said second locking means permitting limited movement between the cover member and bottom member while maintaining a locking relationship such that said first locking means may be moved from a locked to an unlocked position while said second locking means are locked.

2. The package of claim 1 wherein said second locking means comprises a pair of locking devices.

3. The package according to claim 2 wherein said package has an overall rectangular configuration with a front wall, a back wall and a pair of side walls extending upwardly from said base, said second locking means comprising first and second locking devices located on opposed side walls of the package.

4. The package of claim 3, wherein each of said locking means comprises a tab extending from one of said members, a recess formed in the other of said members, said tab member being adapted to engage the recess to thereby lock the members together.

5. The package of claim 3, wherein said cover member and said container member are integrally formed of a plastic material, a hinge member being formed between said cover member and said bottom member, each of said locking means comprising a tab formed on one of said cover and bottom members, a recess formed in the other of said members, said tab being adapted to engage said recess to thereby lock the members together.

6. The package of claim 5 wherein said bottom member has a peripheral edge meeting with a peripheral edge of the cover member, said peripheral edges being in abutment when said container is in a closed position, said second locking means comprising a tab extending from one of said members and a recess formed in the other of said members, said tab member having a first portion extending outwardly from a first one of said peripheral edges and a second locking portion adapted to engage said recess to thereby lock said members together, said locking portion being spaced from the first one of said peripheral edges a greater distance than a distance from said recess to the other of said peripheral edges such that a limited movement of said cover with respect to said bottom is permitted without allowing opening of said second locking means.

7. The package of claim 1, wherein said package has an overall rectangular configuration with the bottom member having a front wall, a back wall and a pair of side walls extending upwardly from said base to define a mouth portion for said bottom member, said cover member being adapted to fit over said mouth portion, said first locking means comprising a tab member extending upwardly from said front wall and adapted to engage with a recess formed in said cover member, said second locking means comprising tab members located on opposed side walls and extending upwardly therefrom, apertures formed within said cover member adapted to receive said side wall tab members, said package being formed of a somewhat flexible plastic material.

8. A child-resistant package comprising a bottom member adapted to receive and contain at least one item to be packaged, said bottom member having a base and at least one wall extending upwardly therefrom, a cover member, first and second cooperative locking means on both said cover member and said bottom member, both of said first and second locking means being operative such that when said cover member is in a closed position with respect to the bottom member, said locking means function to maintain the cover member and bottom member in a locked relationship, said first locking means being such that action to open said first locking means causes said second locking means to become more difficult to unlock.

* * * * *